US012687370B2

(12) United States Patent
Polanich et al.

(10) Patent No.: US 12,687,370 B2
(45) Date of Patent: Jul. 21, 2026

(54) OPERATIONAL STRUCTURE AND METHODS FOR TORSION-DRIVEN, COUNTER ACTING BLOCK AND TACKLE TYPE ENERGY STORAGE AND DEPLOYMENT SYSTEMS

(71) Applicant: SERPENT RURAL SPORTS LLC, Los Gatos, CA (US)

(72) Inventors: Jonathan C. Polanich, Los Gatos, CA (US); James T. Bond, Santa Rosa, CA (US)

(73) Assignee: SERPENT RURAL SPORTS LLC, Dexter, MI (US)

( * ) Notice: Subject to any disclaimer, the term of this patent is extended or adjusted under 35 U.S.C. 154(b) by 219 days.

(21) Appl. No.: 18/671,702

(22) Filed: May 22, 2024

(65) Prior Publication Data

US 2024/0418474 A1 Dec. 19, 2024

Related U.S. Application Data

(60) Provisional application No. 63/508,600, filed on Jun. 16, 2023.

(51) Int. Cl.
*F41B 5/14* (2006.01)

(52) U.S. Cl.
CPC ..... *F41B 5/1469* (2013.01)

(58) Field of Classification Search
CPC ..... F41B 5/12; F41B 5/123; F41B 5/1469; F41B 5/0094
USPC ..... 124/86, 25
See application file for complete search history.

(56) References Cited

U.S. PATENT DOCUMENTS

| | | | | |
|---|---|---|---|---|
| 5,439,231 | A * | 8/1995 | Roberts | F42B 6/06 124/31 |
| 9,719,749 | B1 * | 8/2017 | Prior | F41B 3/005 |
| 10,209,028 | B2 * | 2/2019 | Bofill | F41B 5/123 |
| 2012/0152220 | A1 * | 6/2012 | Barber | F41B 5/12 124/35.1 |
| 2014/0251294 | A1 * | 9/2014 | Novikov | F41B 7/00 124/21 |
| 2017/0328353 | A1 * | 11/2017 | Polanich | F03G 1/02 |
| 2019/0011212 | A1 * | 1/2019 | Shaffer | F41B 5/12 |
| 2019/0242672 | A1 * | 8/2019 | Polanich | F41B 5/0094 |
| 2020/0318930 | A1 * | 10/2020 | Polanich | F41B 5/1403 |
| 2024/0133655 | A1 * | 4/2024 | Chang | F41B 5/123 |

* cited by examiner

*Primary Examiner* — John E Simms, Jr.
(74) *Attorney, Agent, or Firm* — INNOVATION CAPITAL LAW; Vic Lin

(57) ABSTRACT

An operating system of an arrow launching device utilizes the combination of a speed-limited winch together with a nock-release and passive fall away arrow rest within torsion-driven compact arrow launching devices that employ counter-acting block and tackle propulsion. The system enables a novel method of cocking, firing and de-cocking that improves safety, enhances reliability and increases efficiency.

20 Claims, 20 Drawing Sheets

Unloaded

Loading

Cocking

Cocked

OPERATIONAL STRUCTURE AND METHODS FOR TORSION-DRIVEN, COUNTER ACTING BLOCK AND TACKLE TYPE ENERGY STORAGE AND DEPLOYMENT SYSTEMS

CROSS-REFERENCE TO RELATED APPLICATIONS

This application claims benefit of priority of U.S. provisional patent application No. 63/508,600, filed Jun. 16, 2023, the contents of which are herein incorporated by reference.

BACKGROUND OF THE INVENTION

1. Field of the Invention

Embodiments of the invention relate generally to cocking and release systems within compact arrow launching devices that utilize torsion-driven counteracting block and tackle pulley systems.

2. Description of Prior Art and Related Information

The following background information may present examples of specific aspects of the prior art (e.g., without limitation, approaches, facts, or common wisdom) that, while expected to be helpful to further educate the reader as to additional aspects of the prior art, is not to be construed as limiting the present invention, or any embodiments thereof, to anything stated or implied therein or inferred thereupon.

Conventional systems of cocking, uncocking, loading and release are known. However, these conventional systems have limitations. Cocking systems expose the users' fingers to potential danger when loading or unloading an arrow of a fully cocked launching string. Release systems impose tremendous friction and wear on the launching string and introduce shock waves into the string motion during release which reduce arrow speed and accuracy. Release systems must overcome noticeable amounts of resistance that impede a smooth trigger pull. Arrow support systems reduce arrow speeds and reduce accuracy by maintaining contact with the shaft throughout the entire duration of the arrow being shot from the systems. De-cocking systems require manual operation to function or require the arrow to be shot.

In view of the foregoing, there is a need for a novel release system that can overcome the above limitations.

SUMMARY OF THE INVENTION

One aspect of the present invention is achieved by providing the cooperating interaction of novel mechanisms to produce a new, simplified, safe and reliable method of cocking, loading, firing and de-cocking.

A speed-limited winch, mounted within a launching device, is tethered by a cord to a nock-latching arrow release mechanism. The system is configured to operate in concert with a passive, fall-away arrow support system mounted on the movable pulley block that is actuated when engaging or disengaging a fixed structural feature on the frame of the arrow launching device. During the cocking process, the release mechanism can be moved toward the launch string. The release mechanism utilizes a latch that directly engages only the arrow nock when it is attached to the un-cocked launching string. The user is then able to utilize the integrated winch system to simultaneously tension the launching string while drawing back the arrow during the cocking process. If the user's hand should slip away from the winch handle during the process the speed-limited winch system will slowly unwind ensuring the handle is not capable of quickly unwinding and injuring the user's hand. The same mechanism allows the launching string and arrow to be de-cocked without manually cranking the handle.

The release utilizes a release arm connected pivotally to the nock latch to be actuated by a U-shaped orbital bracket to engage or disengage the arrow nock. The U-shaped bracket is movable with very little friction while the system is under tension, retaining the nock, because the release arm can remain in a static position as the bracket moves around the circumference of a round-shaped structure at the end of the release arm. When the U-shaped bracket is moved to the position where its orbit converges with the travel path of the end of the release arm, the release arm and latch pivot into a position that disengages the nock allowing the arrow to be fired.

Embodiments of the present invention provide an operational system comprising a speed-limited winch; a nock release; and a passive fall-away arrow rest, as described in greater detail below.

Embodiments of the present invention further provide a method of cocking and loading, using the operational system described below, wherein a nock release engages an arrow nocked to a launching string and a winch simultaneously cocks and loads the arrow, while a passive fall-away arrow rest engages an arrow shaft for support.

Embodiments of the present invention also provide a method of de-cocking and unloading, wherein the winch slowly unwinds, allowing simultaneous de-cocking and unloading.

Embodiments of the present invention provide a torsion-driven counteracting block and tackle pulley type compact arrow launching device comprising a speed-limited winch mounted within a rear stock of the torsion-driven counteracting block and tackle pulley type compact arrow launching device; and a nock release mounted on a top side of the torsion-driven counteracting block and tackle pulley type compact arrow launching device, wherein the nock release includes a release latch operable to removably engage a nock of an arrow; the speed-limited winch is operable to move the nock release rearward within the torsion-driven counteracting block and tackle pulley type compact arrow launching device to move the arrow from a loaded position to a cocked position; and the speed-limited winch is operable to simultaneously tension a launching string of the torsion-driven counteracting block and tackle pulley type compact arrow launching device while drawing back the arrow during a cocking process.

Embodiments of the present invention provide a cocking and release system within a compact arrow launching device comprising a speed-limited winch mounted within a rear stock of the compact arrow launching device; and a nock release mounted on a top side of the compact arrow launching device, wherein the nock release includes a release latch operable to removably engage a nock of an arrow; the speed-limited winch is operable to move the nock release rearward within the compact arrow launching device to move the arrow from a loaded position to a cocked position; the speed-limited winch is operable to simultaneously tension a launching string of the torsion-driven counteracting block and tackle pulley type compact arrow launching device while drawing back the arrow during a cocking process; and the speed-limited winch prevents an uncontrolled reversal of the nock release if a winding force is removed from the speed-limited winch during the cocking process.

Embodiments of the present invention provide an operating system of an arrow launching device comprising a speed-limited winch mounted within a rear stock of the arrow launching device; a nock release mounted on a top side of the arrow launching device; and a passive fall-away arrow rest mounted within a pulley block along with an actuator mounted on a frame of the arrow launching device, below the pulley block, wherein the nock release includes a release latch operable to removably engage a nock of an arrow; the speed-limited winch is operable to move the nock release rearward within the arrow launching device to move the arrow from a loaded position to a cocked position; the speed-limited winch is operable to simultaneously tension a launching string of the torsion-driven counteracting block and tackle pulley type arrow launching device while drawing back the arrow during a cocking process; the passive fall-away arrow rest engages an arrow shaft mid-way through the cocking process, without assistance from the user; and the passive fall-away arrow rest, during a firing sequence, supports the arrow only through a mid-way point of a deployment of the arrow.

These and other features, aspects and advantages of the present invention will become better understood with reference to the following drawings, description and claims.

BRIEF DESCRIPTION OF THE DRAWINGS

Some embodiments of the present invention are illustrated as an example and are not limited by the figures of the accompanying drawings, in which like references may indicate similar elements.

FIG. 10 is a transparent side elevation view showing the release in the release port with the arrow in the cocked position with the safety on;

Figure 1:
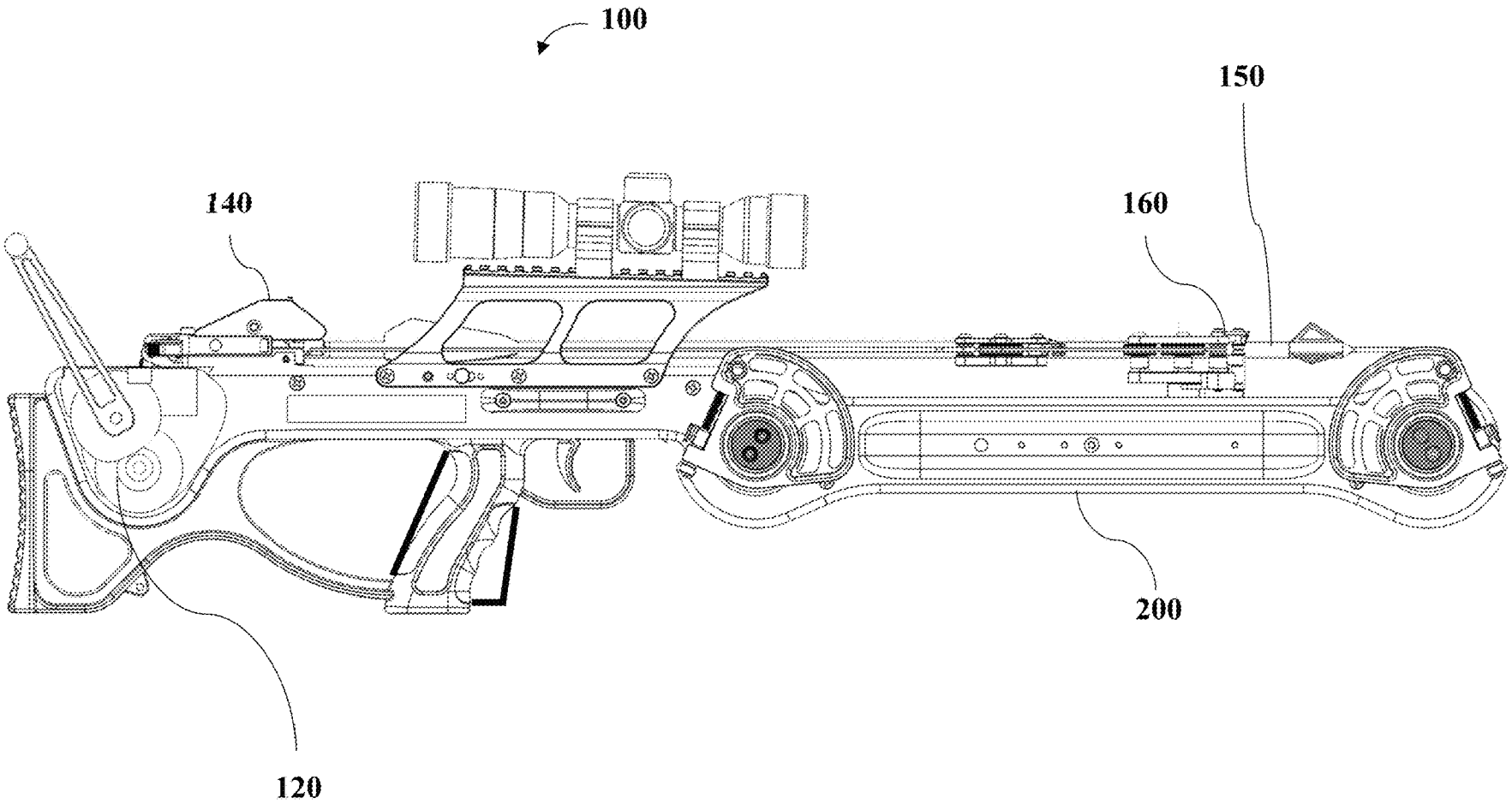
FIG. 1 is side elevation view of a torsion-driven counteracting block and tackle pulley type compact arrow launching device depicting an overview of the novel operational structures.

Unless otherwise indicated illustrations in the figures are not necessarily drawn to scale.

The invention and its various embodiments can now be better understood by turning to the following detailed description wherein illustrated embodiments are described. It is to be expressly understood that the illustrated embodiments are set forth as examples and not by way of limitations on the invention as ultimately defined in the claims.

DETAILED DESCRIPTION OF THE PREFERRED EMBODIMENTS AND BEST MODE OF INVENTION

The terminology used herein is for the purpose of describing particular embodiments only and is not intended to be limiting of the invention. As used herein, the term "and/or" includes any and all combinations of one or more of the associated listed items. As used herein, the singular forms "a," "an," and "the" are intended to include the plural forms as well as the singular forms, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof.

Unless otherwise defined, all terms (including technical and scientific terms) used herein have the same meaning as commonly understood by one having ordinary skill in the art to which this invention belongs. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein.

In describing the invention, it will be understood that a number of techniques and steps are disclosed. Each of these has individual benefit and each can also be used in conjunction with one or more, or in some cases all, of the other disclosed techniques. Accordingly, for the sake of clarity, this description will refrain from repeating every possible combination of the individual steps in an unnecessary fashion. Nevertheless, the specification and claims should be read with the understanding that such combinations are entirely within the scope of the invention and the claims.

In the following description, for purposes of explanation, numerous specific details are set forth in order to provide a thorough understanding of the present invention. It will be evident, however, to one skilled in the art that the present invention may be practiced without these specific details.

The present disclosure is to be considered as an exemplification of the invention and is not intended to limit the invention to the specific embodiments illustrated by the figures or description below.

As is well known to those skilled in the art, many careful considerations and compromises typically must be made when designing for the optimal configuration of a commercial implementation of any system, and in particular, the embodiments of the present invention. A commercial implementation in accordance with the spirit and teachings of the present invention may be configured according to the needs of the particular application, whereby any aspect(s), feature(s), function(s), result(s), component(s), approach(es), or step(s) of the teachings related to any described embodiment of the present invention may be suitably omitted, included, adapted, mixed and matched, or improved and/or optimized by those skilled in the art, using their average skills and known techniques, to achieve the desired implementation that addresses the needs of the particular application.

Broadly, embodiments of the present invention provide an operating system that utilizes the combination of a speed-limited winch together with a nock-release and passive fall away arrow rest within torsion-driven compact arrow launching devices that employ counter-acting block and tackle propulsion. The system enables a novel method of cocking, firing and de-cocking that improves safety, enhances reliability and increases efficiency.

Referring to FIGS. 1 through 20, wherein like reference numerals refer to like components in the various views, there is illustrated therein a new and improved operating structure and methods for compact arrow launching devices that utilize torsion-driven, counter-acting block and tackle propulsion systems, generally denominated 100 herein.

As illustrated in FIG. 1, in accordance with the present invention, the operating system 100 is shown mounted to a compact arrow launching device that utilizes a torsion-driven, counter-acting block and tackle propulsion system 200. The operating system 100 is designed to coordinate novel mechanisms to deliver an improved method for loading, cocking, and firing. A speed-limited winch 120 is mounted within the rear stock, a nock release 140 is mounted on the top of system 200, and a passive fall-away arrow rest 160 is mounted within the pulley block along with its actuator mounted on the frame just below it. When cocking, nock release 140 is moved into the pulley block and engages the nock of an arrow 150 that is nocked onto the launching string. This allows for cocking and loading of the arrow to happen simultaneously, saving the user time and increasing safety as the user's fingers are not involved in the process. As nock release 140 does not engage the launching string, it does not contribute to wear on the launching string. Nock release 140 is tethered via a cord to the speed-limited winch 120. When the winch handle is cranked the nock release 140 pulls the arrow nock rearward, simultaneously loading and cocking the arrow.

Should the user's hand slip off the crank handle, it will slowly and safely uncrank, as the speed-limited winch will allow the arrow and release to slowly return to its original position in the pulley block. This same feature allows the arrow launching device to be passively de-cocked and unload simultaneously, in a safe and efficient manner, also eliminating the need for anti-dry fire mechanism. Passive fall-away arrow rest 160 engages the arrow shaft mid-way through cocking process, without assistance from the user. Additionally, during the firing sequence, passive fall-away arrow rest 160 will support the arrow only through the mid-way point of the deployment, reducing accuracy and friction bias to the arrow. Contributing mechanisms of operating system 100 will be further detailed in the balance of the specification.

Figure 2:
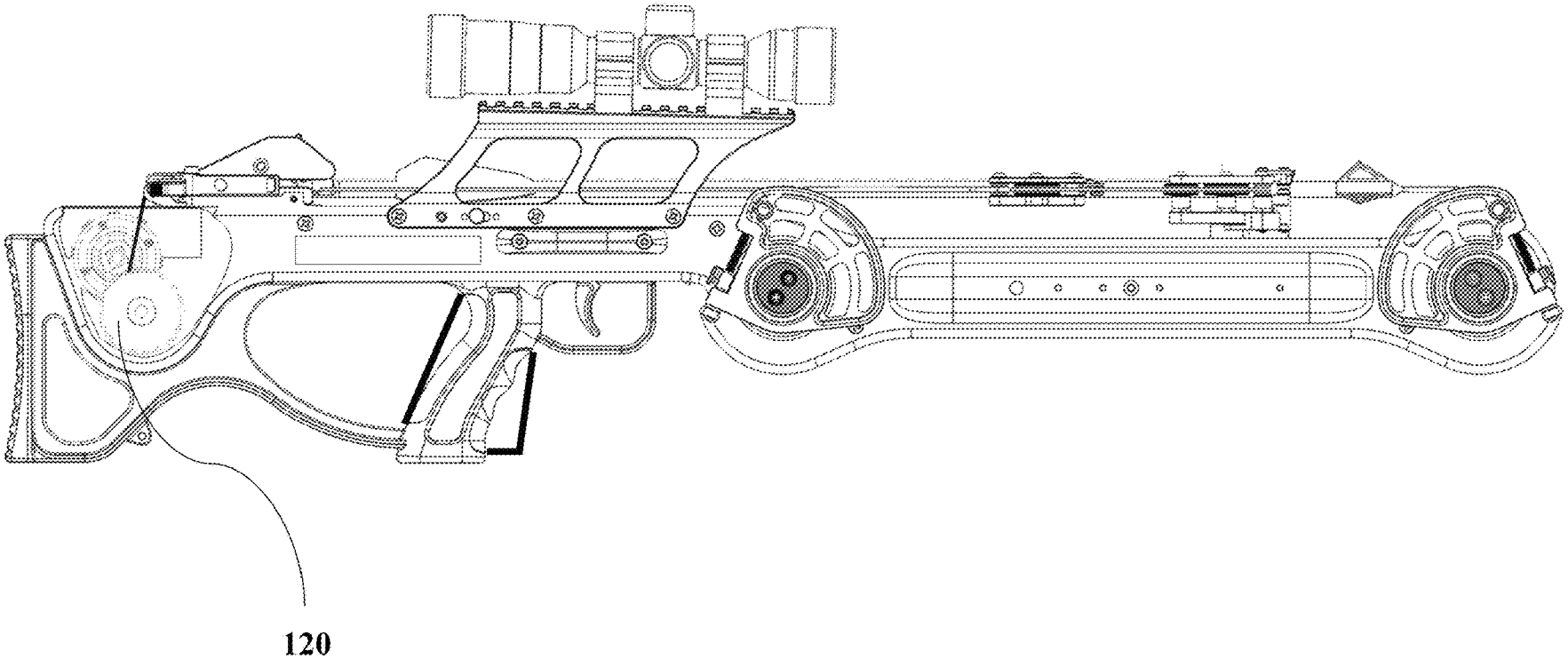
FIG. 2 is similar to FIG. 1, featuring a transparent view the frame to reveal the integrated speed-limited winch.
Figure 3B:
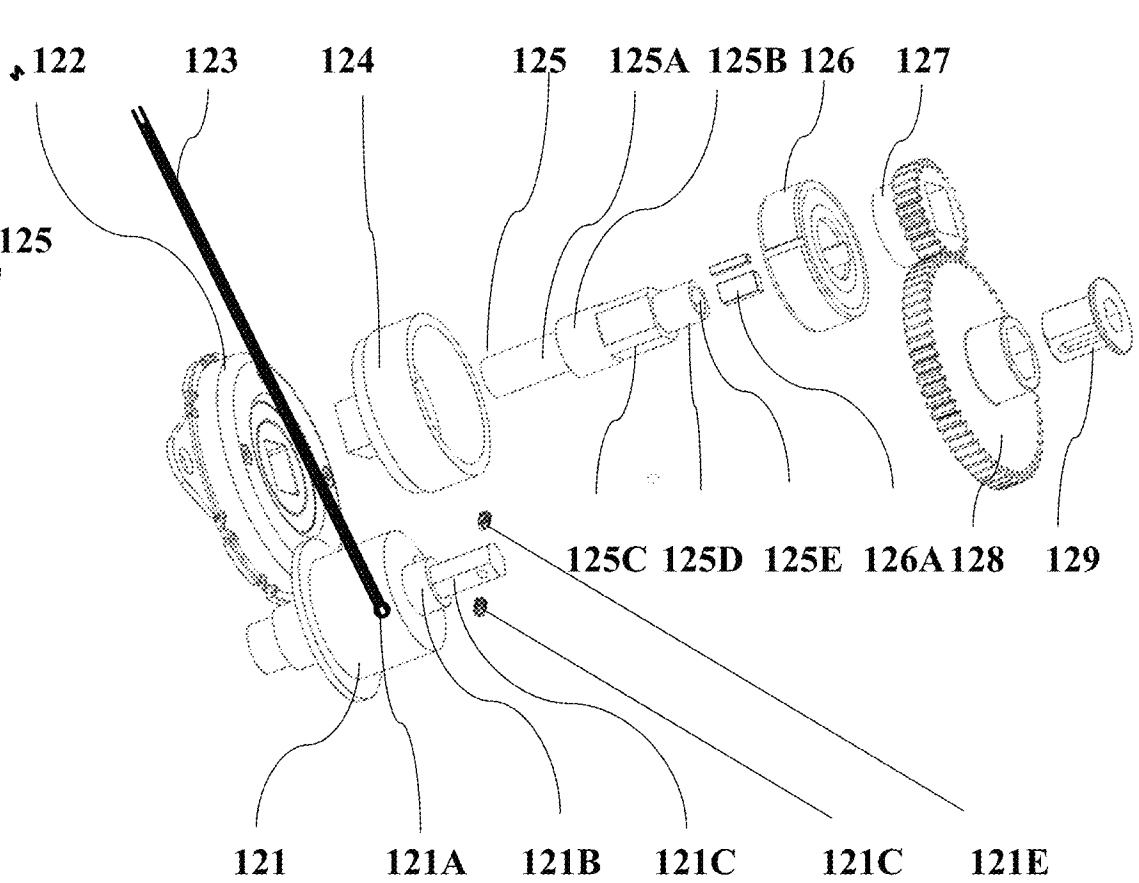
FIGS. 3A and 3B are perspective views of the speed-limited winch assembly.
Figure 3A:
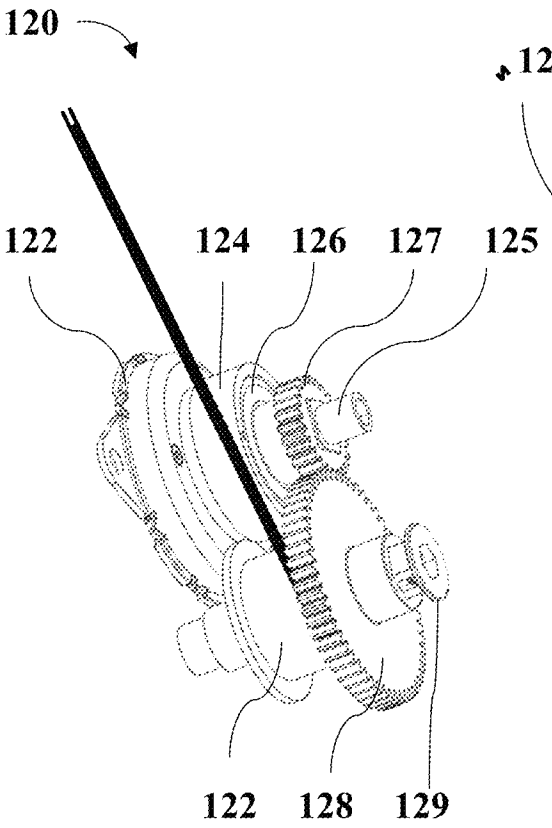

FIG. 2 illustrates the speed-limited winch 120 mechanism, as seen in a cutaway view of the stock of arrow launching system 200. FIGS. 3A and 3B are provided to illustrate the components of speed-limited winch 120. Winch cord 123 attaches to arbor 121 at cord anchorage 121A. Arbor gear mount 121B and clutch shaft 121C are used to host big gear 128. A portion of the bore of big gear 128 is round where it mounts over arbor gear mount 121B. The other portion of the bore within the protruding flange of big gear 128 is angled to fit over the angled shape exterior of clutch sleeve 129. Similarly, the angled bore of clutch sleeve 129 mounts on onto angled clutch shaft 121C such that it can slide along the shaft without turning. As clutch shaft 121C protrudes beyond the flange of big gear 128, clutch sleeve 129 can be positioned to engage within the flange of big gear 128 thus uniting big gear 128 with arbor 121. When clutch sleeve 129 is positioned outside the flange within big gear 128, arbor 121 is permitted to turn independently of the gear, allowing winch cord 123 to be paid out. This portion of the assembly connects to small gear 127, which serves as both a drive gear or an idle gear based upon the direction of rotation. Small gear 127 is mounted on shaft 125 at the square drive gear mount 125B, indirectly connecting it to speed-limiter 122 via bearing housing 124. Bearing housing 124 has a square-shaped flange that fits within the squared shape bore of speed-limiter 122. Speed-limiter 122 regulates bearing housing 124 to about 6-12 revolutions in either direction within a minute of time depending on torque load. The bore within the squared flange of bearing housing 124 is round to accept the round shaft end 125A. One-way bearing 126 is mounted onto shaft 125 at bearing mount 125A with shaft key 126A and united within the large cylindrical recess of bearing housing 124 with another shaft key 126A. At the end of shaft 125 is winch port 125D for engaging with a crank handle. When shaft 125 and small gear 127 turn in one direction to drive big gear 128 during the cocking process, the one-way bearing 126 allows them to turn freely without engaging speed-limiter 122. When big gear 128 drives small gear 127 during the de-cocking process, shaft 125 locks in unison with one-way bearing 126 and bearing housing 124 thus engaging speed-limiter 122. This allows the system to slowly release tension within the arrow launching device.

Figure 4:
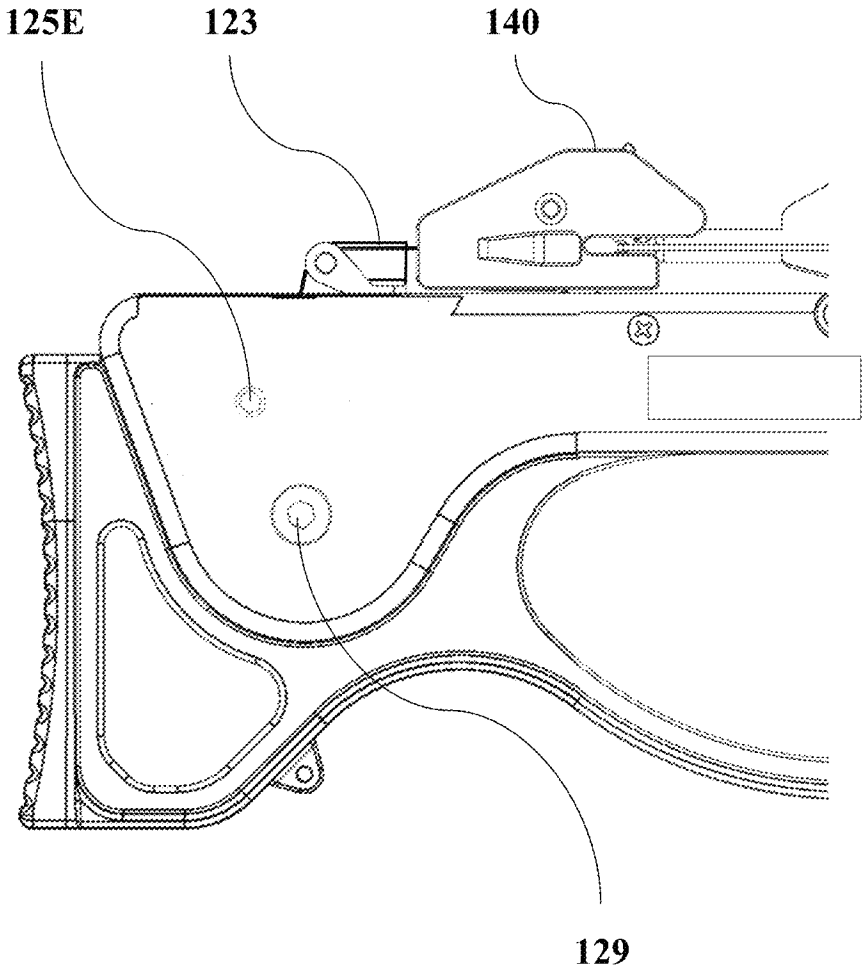
FIG. 4 is a side elevation view of the winch housing illustrating the control mechanisms.
Figure 5A:
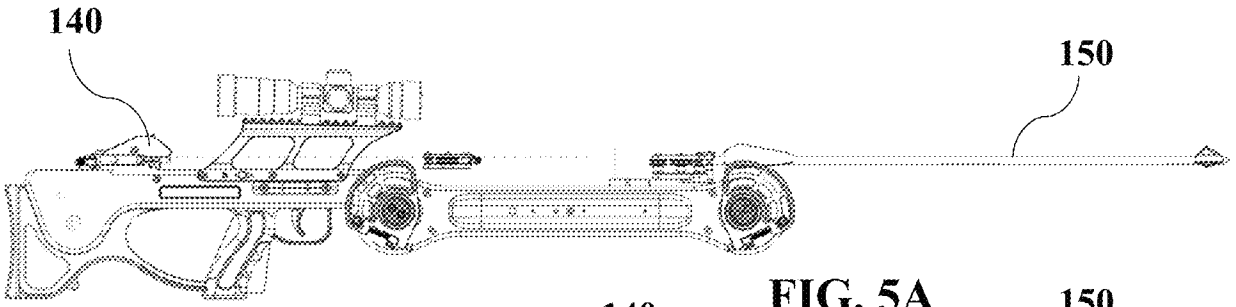
FIGS. 5A through 5D illustrate side elevation views showing an overview of the modes of operation.
Figure 5B:
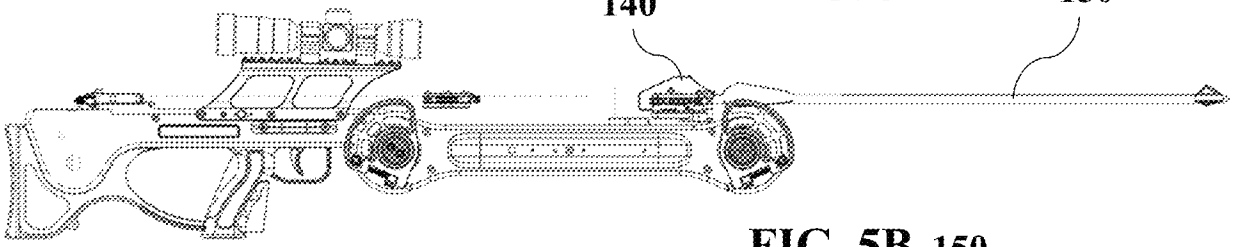
Figure 5C:
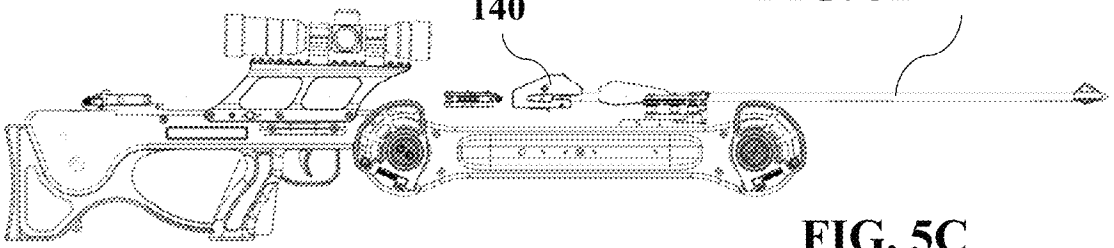
Figure 5D:
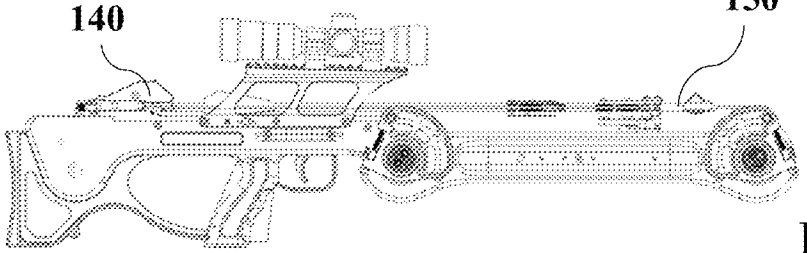

FIG. 4 shows the speed-limited winch 120 tethered to the nock release 140 via winch cord 123. Also shown are the portions of the speed-limited winch 120 visible from the exterior of the arrow launching device, winch port 125D and clutch sleeve 129.

FIGS. 5A through 5D illustrate an overview of the role of nock release 140 within the methods of use. In the unloaded position, an arrow 150 may be nocked to the launching string while the nock release 140 is stationed in a fixed position at the other end of the arrow launching device. During the cocking process, the nock release is latched onto the nock of arrow 150. While cocking, the arrow 150 is simultaneously loaded. When cocked, nock release 140 returns to a fixed position on the arrow launching device, ready for firing the arrow 150.

Figure 6:
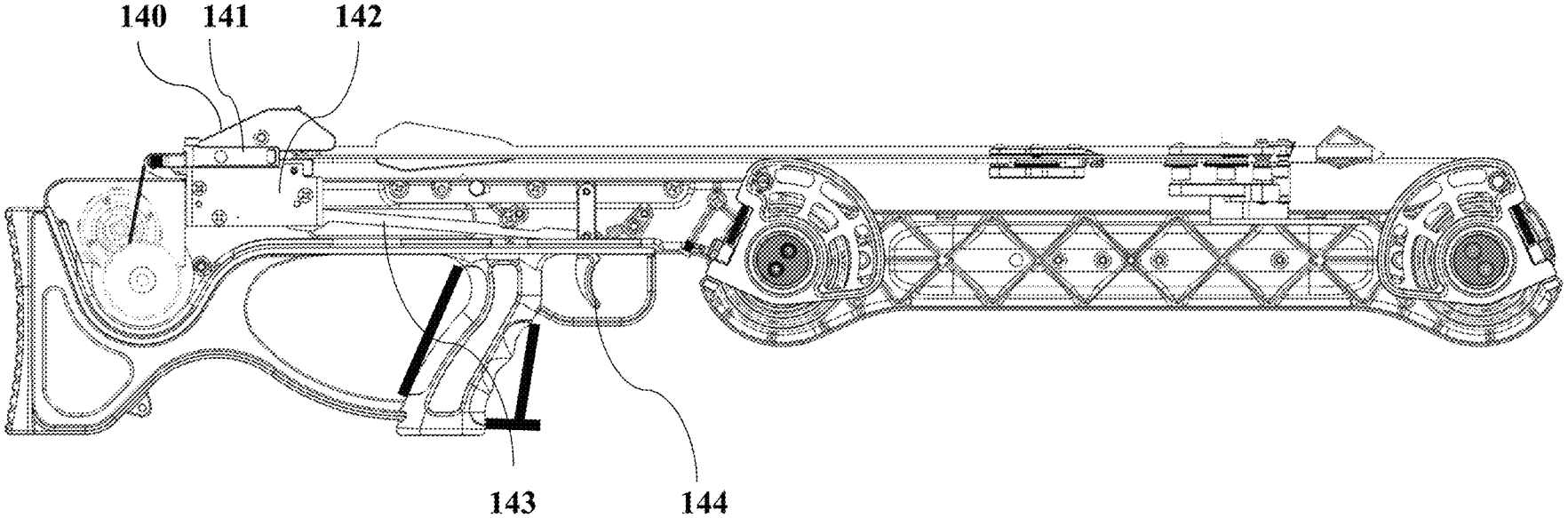
FIG. 6 is a side elevation view with a transparent frame, revealing the locations of the release and release port in relation to the winch, trigger and trigger actuation mechanisms.

FIG. 6 shows the nock release 140 fixed to the release port 142 by the port latches 141. Trigger 144 is connected via push rod 143 to firing mechanisms within release port 142.

Figure 7:
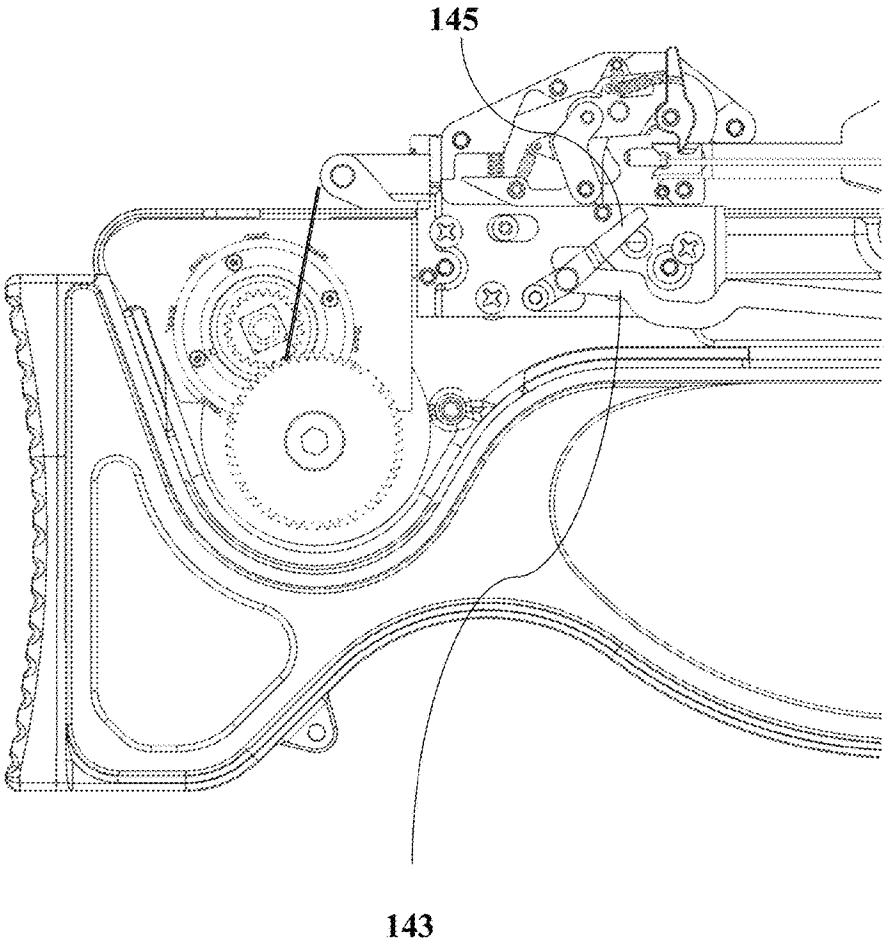
FIG. 7 is a side elevation frame-transparency view showing the location of the release and release port.

FIG. 7 illustrates the push rod 143 connection to firing lever 145 within release port 142.

Figure 8:
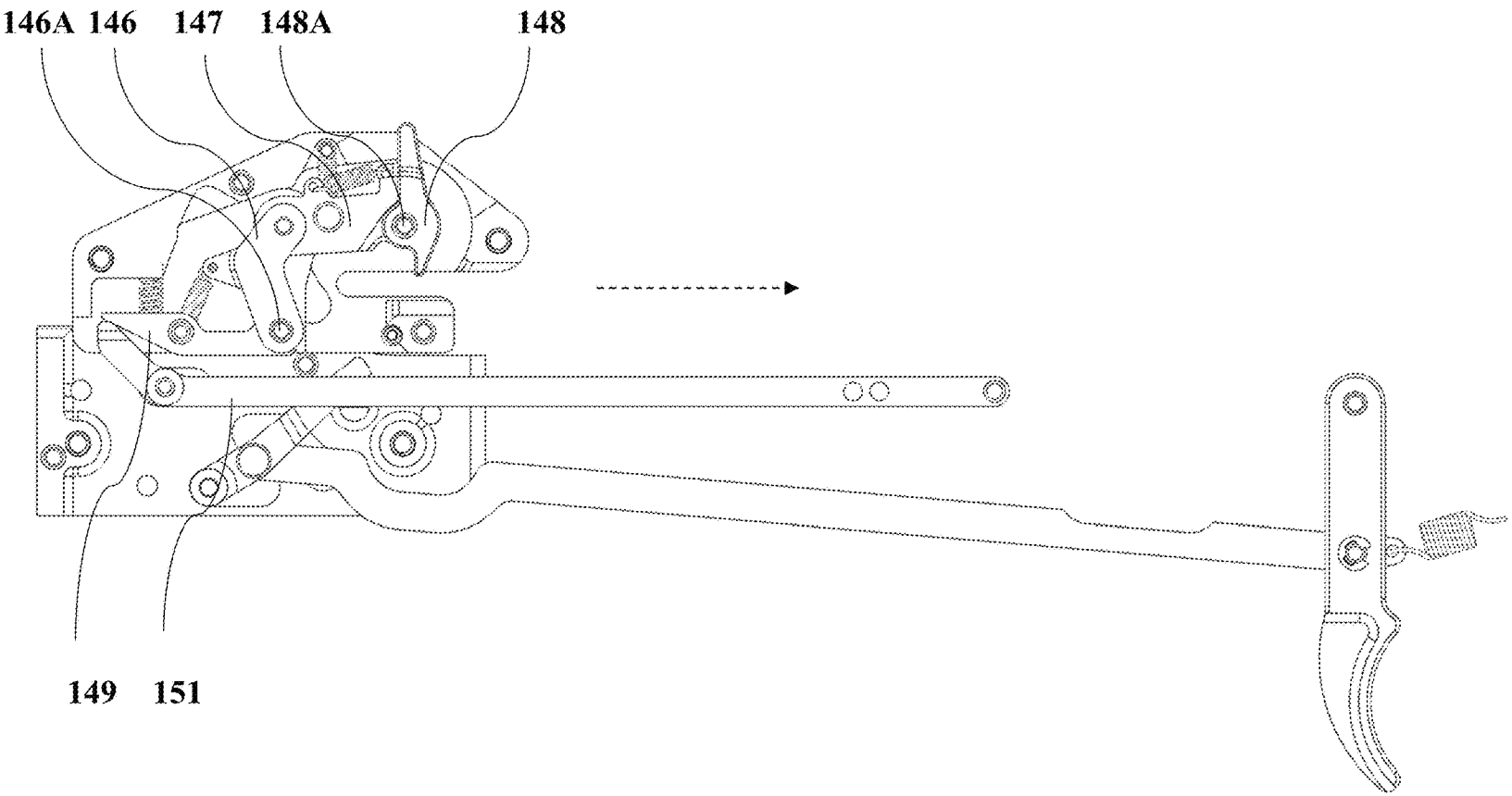
FIG. 8 is a side elevation transparent view of the release mechanism docked in the port along with its relation to the trigger mechanism.

FIG. 8 reveals the internal mechanisms within nock release 140 and release port 142 prior to loading. The safety link 151 is mounted within release port 142 and in the 'ON' position at the rearward extreme of it permissible travel. The safety latch 149 is in the upward position where is blocks the movement of safety bar 146A and attached U-bracket 146. release arm 147 is hinged to release latch 148 via shared axle 148A. The mechanism is ready to load.

Figure 9:
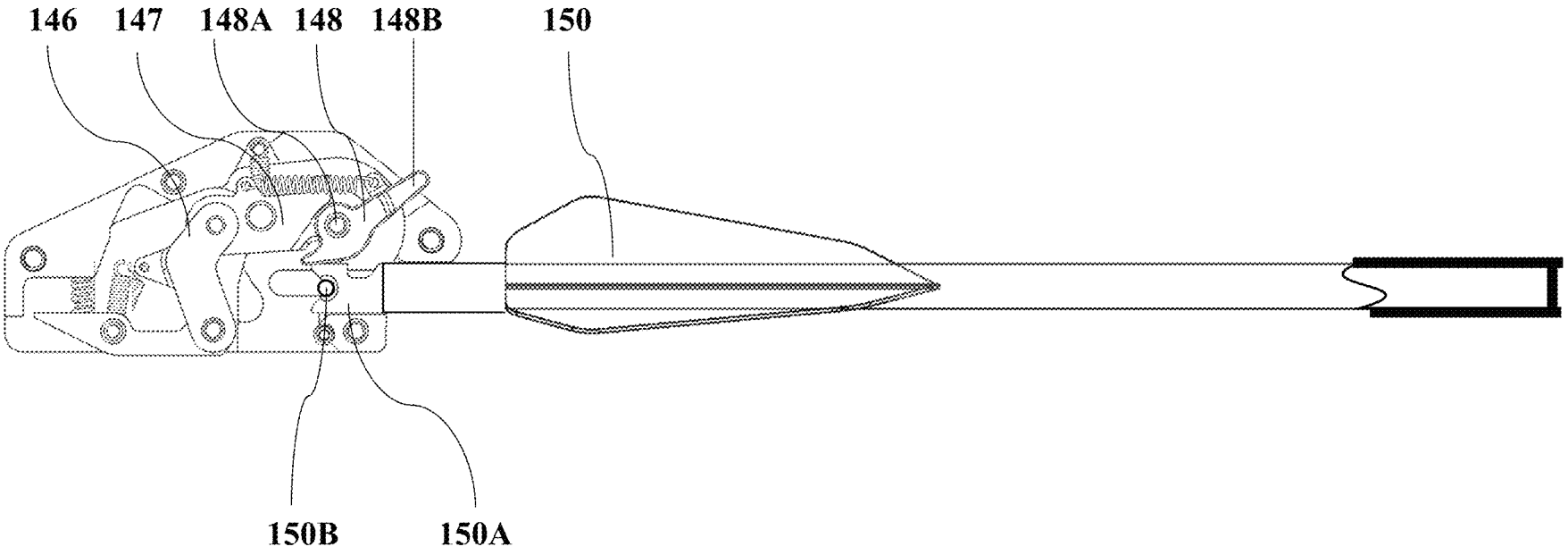
FIG. 9 is a transparent side elevation view showing the release in a position where it engages the arrow nock.

FIG. 9 shows the loading position, as internal mechanism within the nock release 140 receives the launching string 150B (shown as a cross-section). The pulley block is omitted from view to clearly illustrate. Nock latch 148 hinges backward to permit the notched arrow nock 150A to move to a position where it is captured by the nock latch 148. Notably, the latch switch 148B moves forward during the process, which can also be manually operated to detach the notched arrow nock 150A (during the unloading process). U-bracket 146 and release arm 147 remain stationary throughout the loading (and unloading) process. The system is ready to cock.

Figure 10:
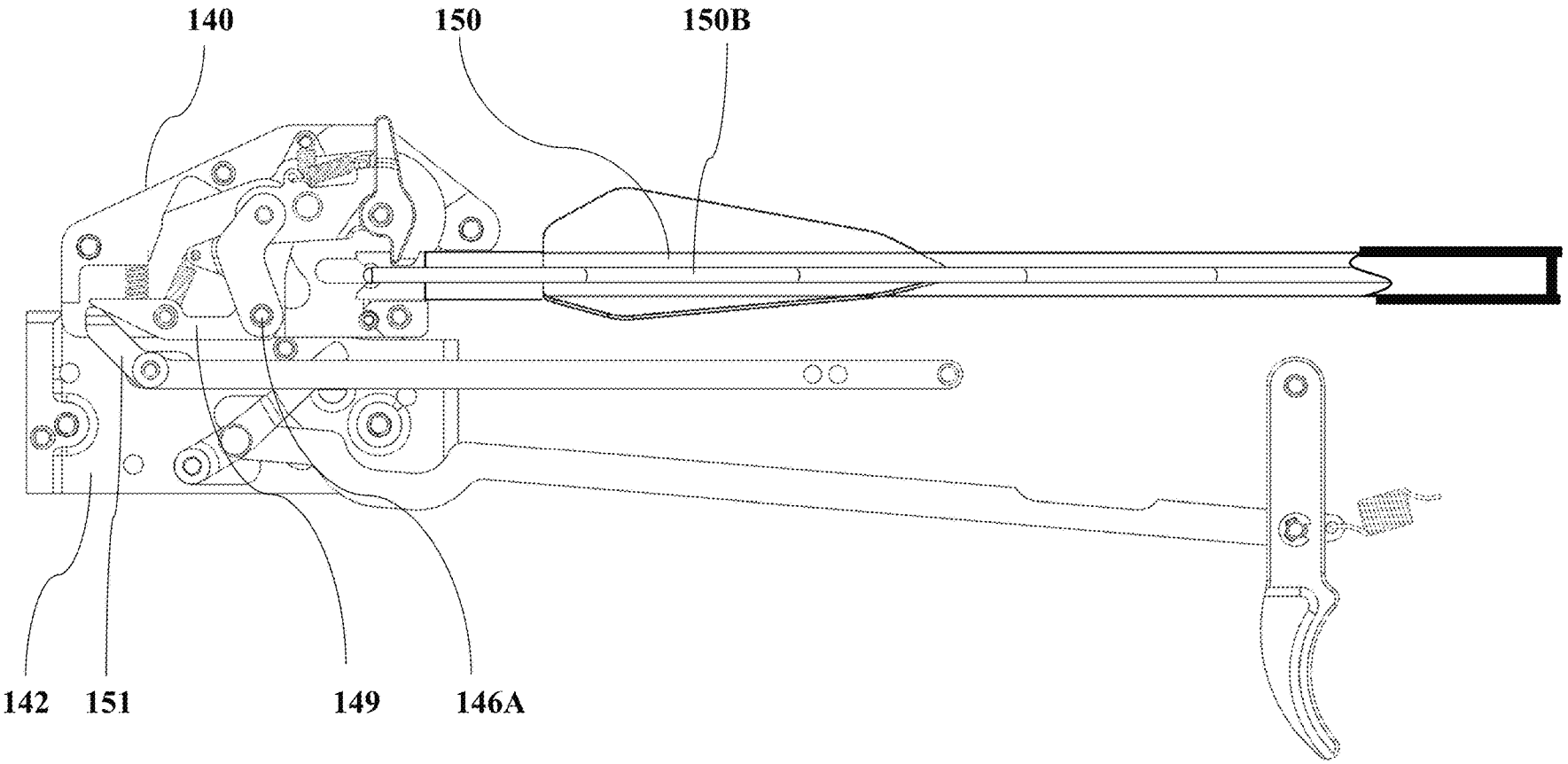

FIG. 10 illustrates the nock release 140 in a fully cocked position. The nock latch 148 retains the notched arrow nock 150*a* and arrow 150 against the tension of the arrow launching string. The safety link 151 remains in the 'ON' position at the rearward extreme of it permissible travel. The safety latch 149 is in the upward position where continues to block the movement of safety bar 146*a* and attached U-bracket 146. The mechanism is ready for the safety to be turned to the 'OFF' position when ready to fire.

Figure 11:
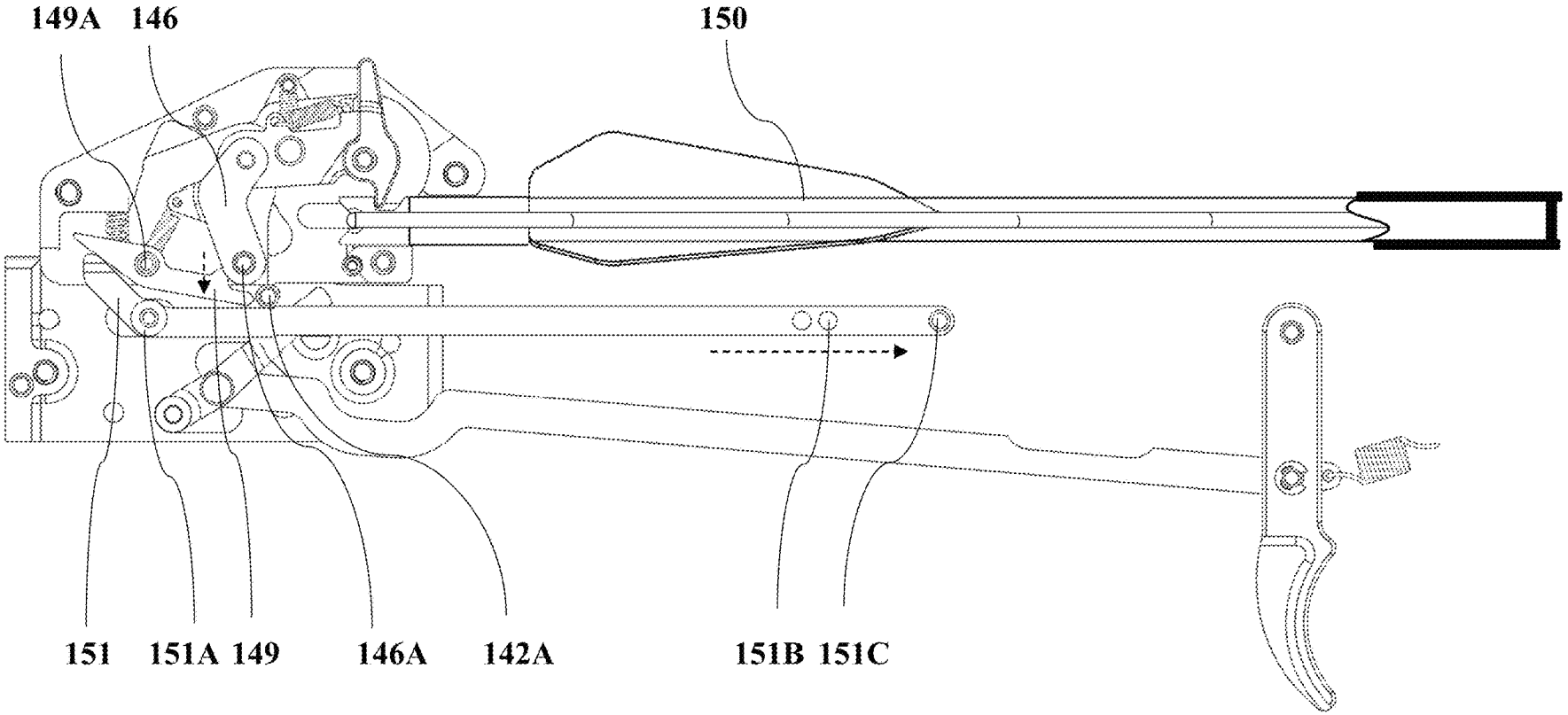
FIG. 11 is a transparent side elevation view showing the release in the release port with the arrow in the cocked position with the safety off.

FIG. 11 reveals the safety mechanism in the 'OFF' position. Safety switch 151C is moved forward along with the safety link 151, aided by the link wheel 151A, and the detent relief 151B in the safety link 151 moves past a static ball-nose detent within the frame (not shown). The rear of the safety link 151 pushes forward into the rear of the safety latch 149 which pivots upward on axle 149A so that it forward structure pivots downward, out of the way of the safety bar 146A. The U-bracket 146 is now in a position where it can be actuated to fire the arrow 150.

Figure 12:
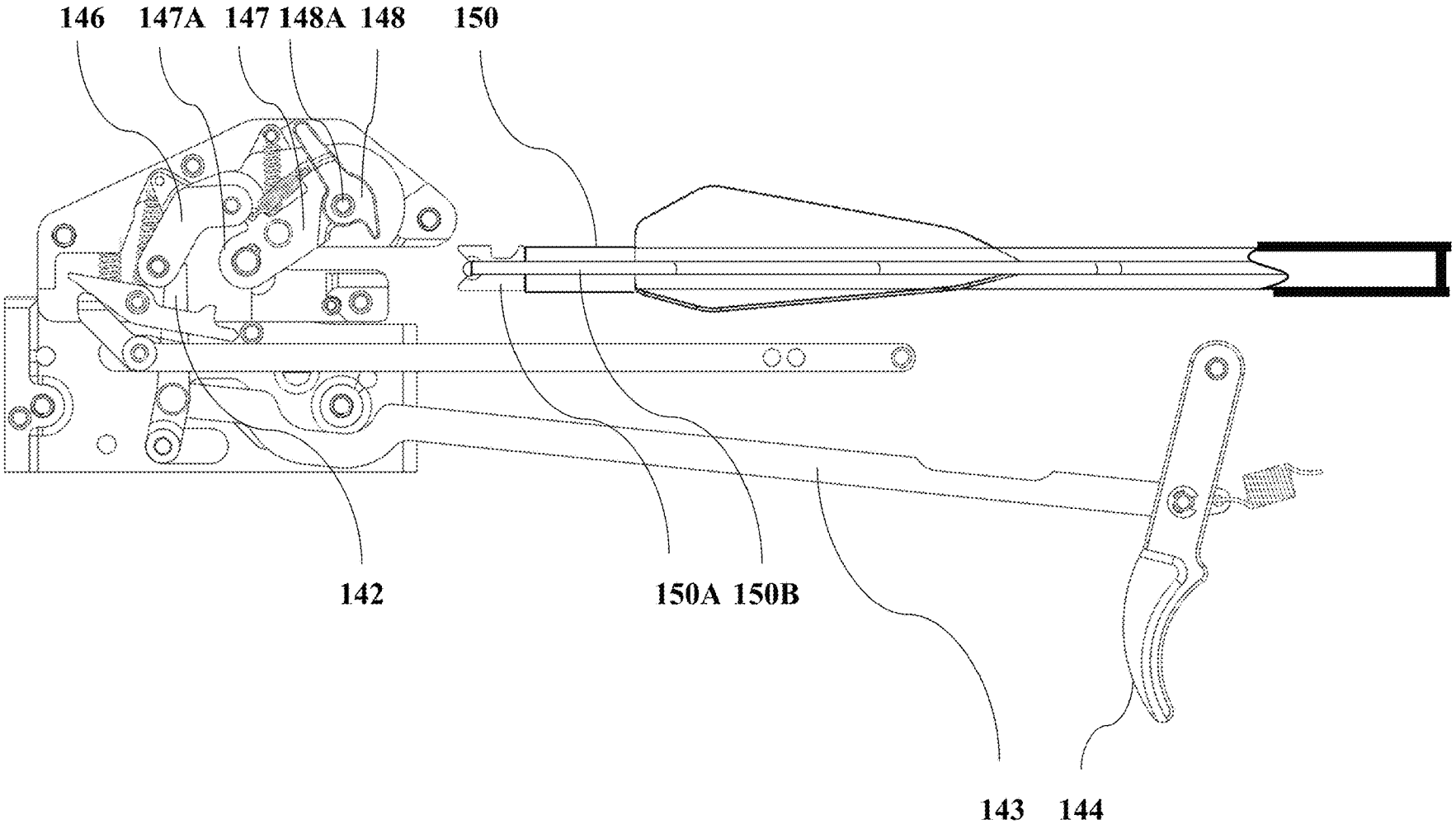
FIG. 12 is a transparent side elevation view showing the release in the release port with the arrow in the firing position.

FIG. 12 shows the nock release 140 in the fired position. The trigger 144 is pulled rearward, moving the push rod 143 to pivot the firing level 145 into a position where it makes contact with the safety bar 146*a* and rotates the U-bracket 146 upward. With the U-bracket 146 no longer supporting the rear of the release arm 147, it pivots downward allowing the nock latch 148 to move up and out of the notch in the notched arrow nock 150A. The arrow 150 is released, driven by the tensioned launching string 150B. The following three figures illustrate the details.

Figure 13B:
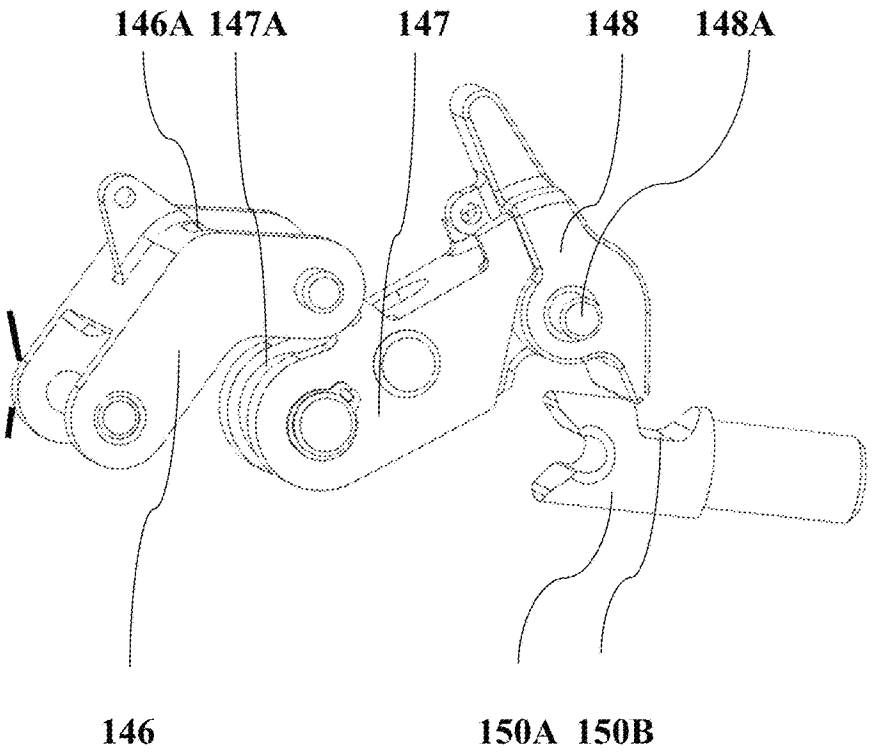
FIGS. 13A and 13B are isolated perspective views of the release components and the nock.
Figure 13A:
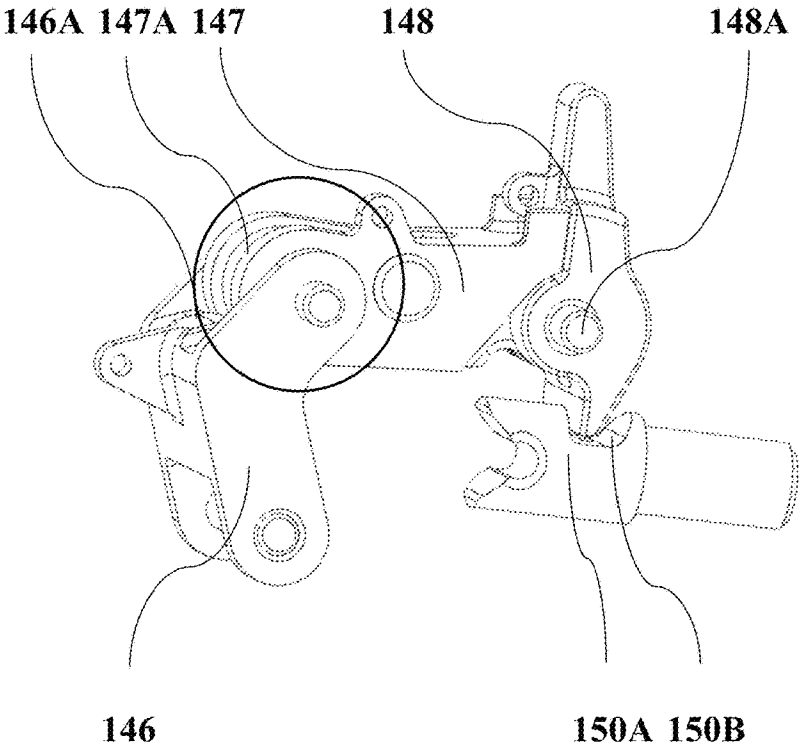

FIGS. 13A and 13B detail the release sequence of the mechanism. Prior to firing, the saddle 146A of U-bracket 146 supports the round structure 147A at the rear of release lever 147. In this mode, the forward structure of release arm 147 holds release latch 148 in a position on the shared axle 148A that it retains notched arrow nock 150A by the notch 150B. During the firing sequence, the U-bracket 146 is pushed upward and its saddle 146A no longer supports the round structure 147A at the rear of release lever 147. As this happens, the rear of release lever 147 pivots downward, lifting the release latch 148 out of contact with the notch 150B on the top of the notched arrow nock 150A, allowing the arrow launch. Details of the connection point of the saddle 146A and the round structure 147A are further detailed.

Figure 14:
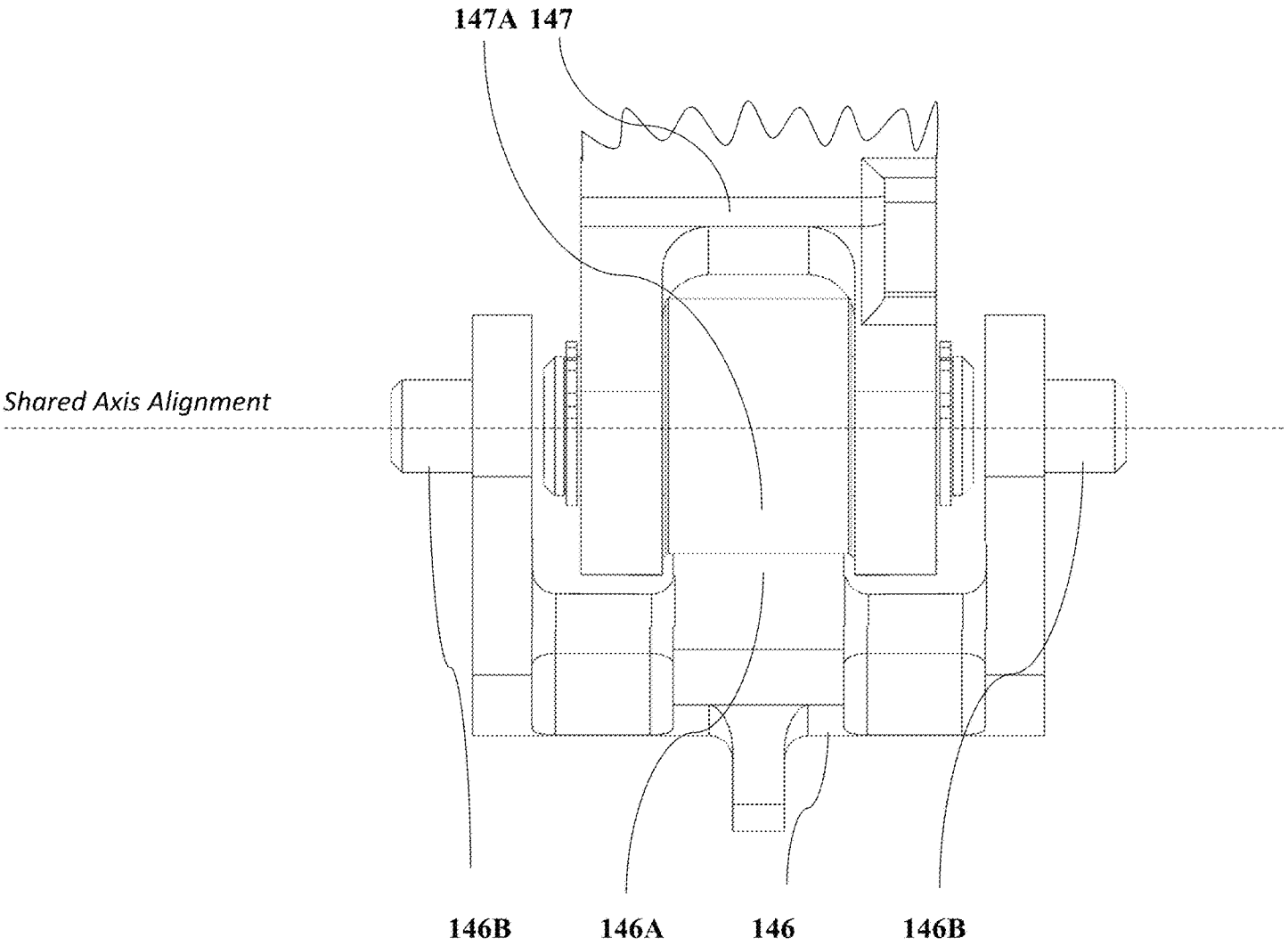
FIG. 14 is a partial closeup posterior view, taken about the circle in FIG. 13A, showing the release arm and U-bracket.

FIG. 14 shows saddle 146A supporting the round structure 147A of release arm 147. U-bracket 146 rotates on two outward axles 146B such that the only portion of it that can make contact with round structure 147A is the saddle 146A, which traces outer face of the round structure 147A as the U-bracket 146 rotates. This is possible because the U-bracket 146 can move independently of round structure 147A while the outward axles 146B are in shared axis alignment with the center-point of the round structure 147A. Further details of the alignment are detailed.

Figure 15B:
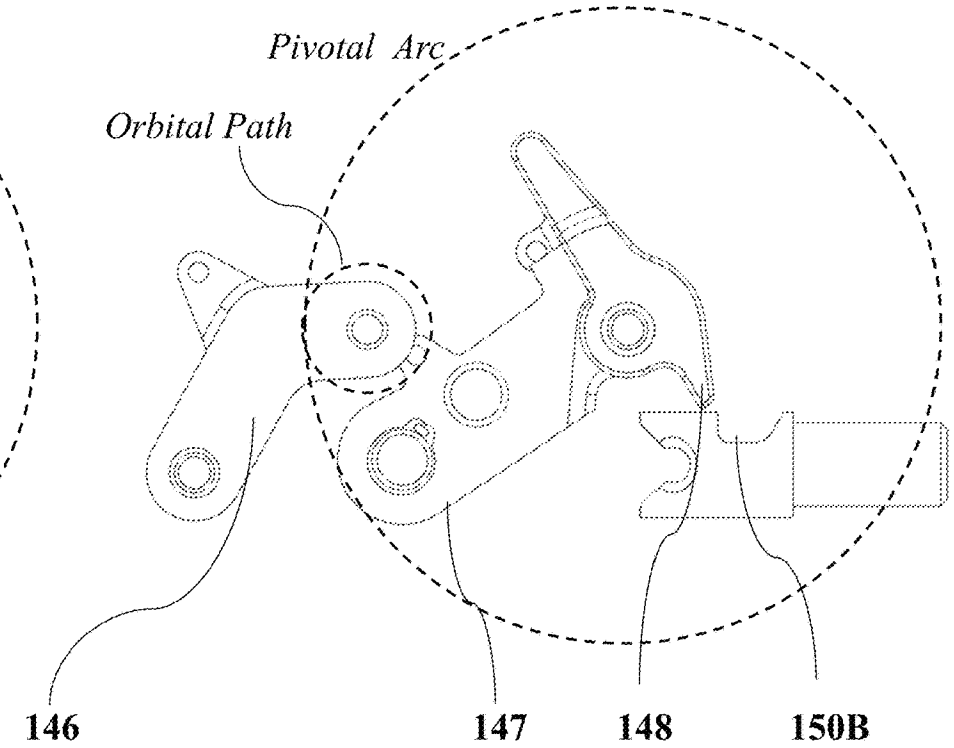
FIGS. 15A and 15B are side elevation views showing orbital pathway of the U-bracket in relation to the pivot arc of the release arm.
Figure 15A:
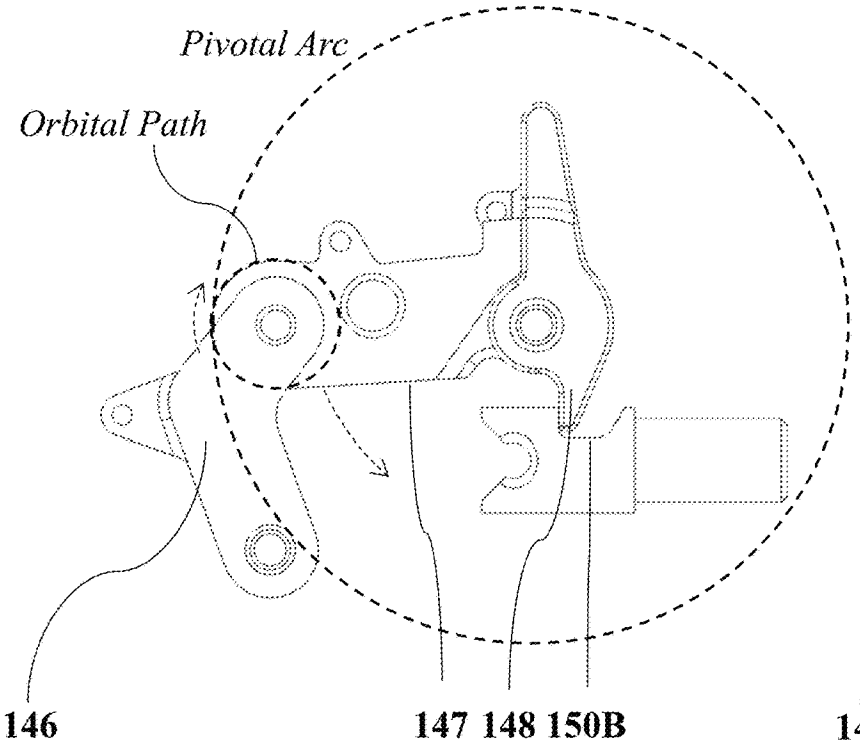

FIGS. 15A and 15B illustrate the alignment required to achieve functionality within the nock release 140. The orbital path of the saddle 146A portion of U-bracket 146 is aligned with the pivotal arc travel at the end of the round structure 147A of release arm 147. The round structure 147A is supported until the saddle 146A is at the point of its orbital path that is converges with the pivotal arc travel of the end of the round structure 147A.

Figure 16:
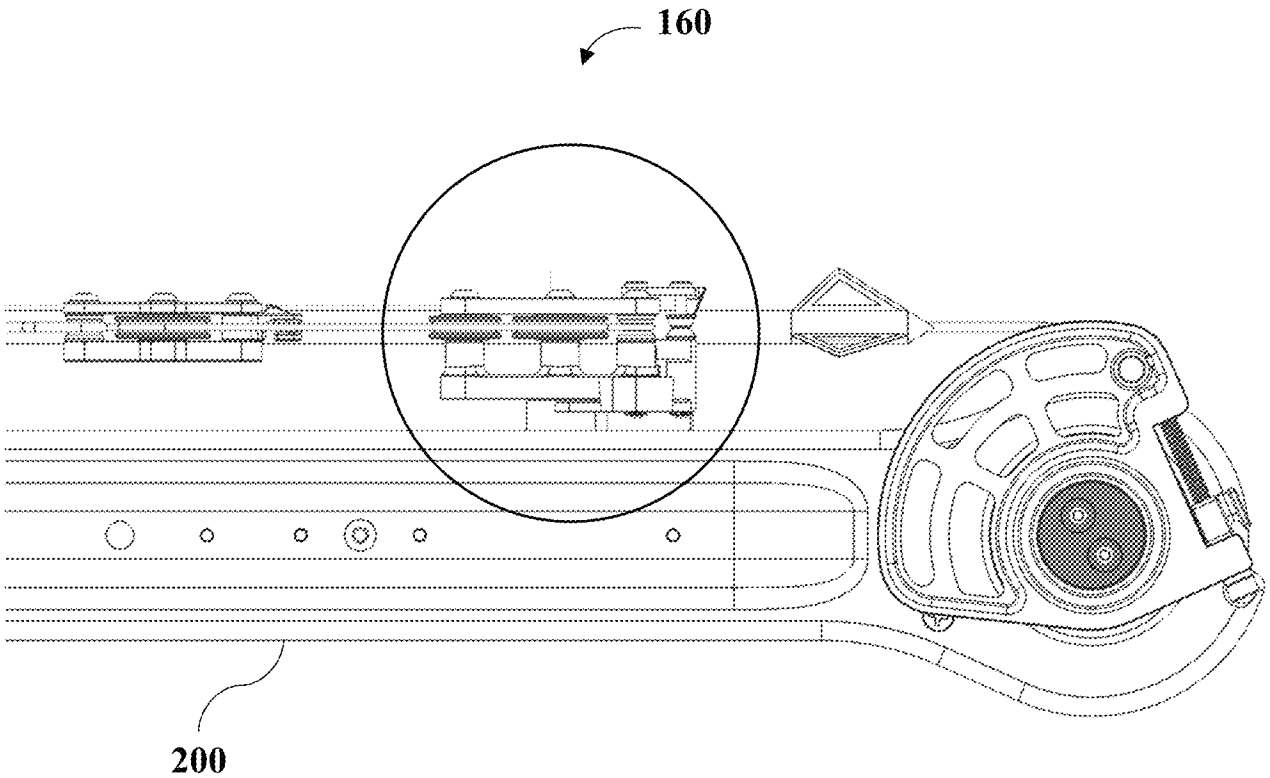
FIG. 16 is a side elevation view showing the location of the passive fall-away arrow rest on a compact torsion-drive arrow launching device utilizing a counter-acting block and tackle pulley system.

FIG. 16 highlights the location of the passive fall-away arrow rest 160 on a compact arrow launching device that utilizes a torsion-driven, counter-acting block and tackle propulsion system 200. Details are expounded.

Figure 17A:
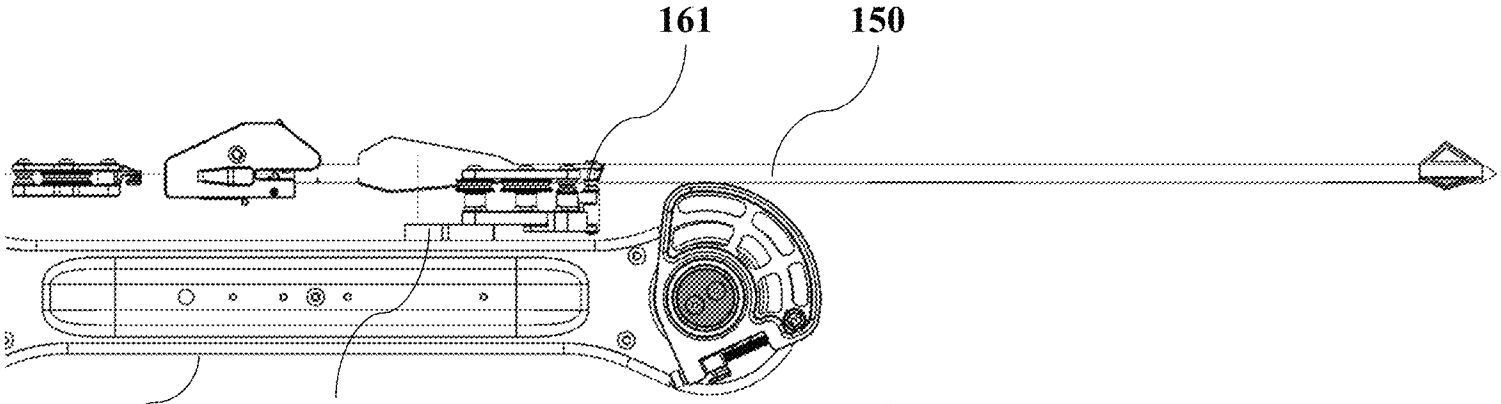
FIGS. 17A and 17B are side elevation views showing the passive fall-away arrow rest on the moveable pulley block with respect to the position of the fixed actuation structure of the system.
Figure 17B:
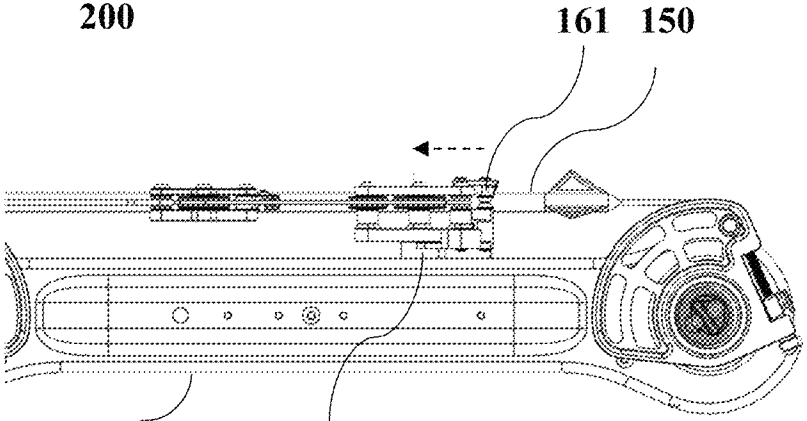

FIGS. 17A and 17B shows two parts of passive fall-away arrow rest 160. Fixed structure 162 is mounted on top of system 200. Lateral shaft brackets 161 are mounted on the movable pulley block. Lateral shaft brackets 161 move to grip the shaft of arrow 150 as the movable pulley block and lateral shaft brackets 161 make contact with the fixed structure 162 is mounted on top of system 200. Further details are revealed.

Figure 18B:
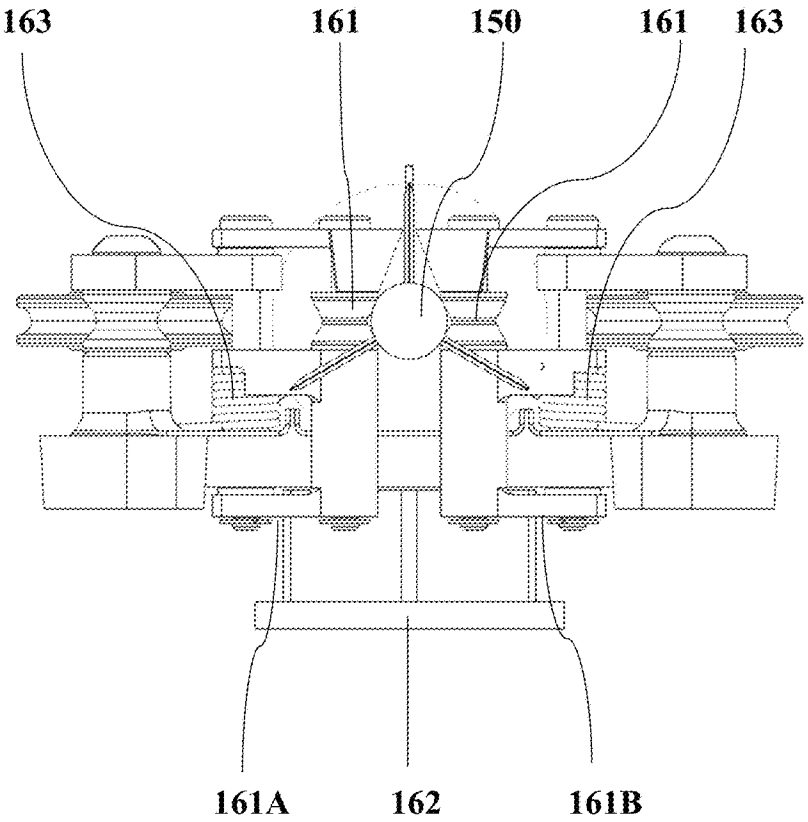
FIGS. 18A and 18B are frontal views showing the passive fall-away arrow rest brackets on the moveable pulley block engaging the arrow.
Figure 18A:
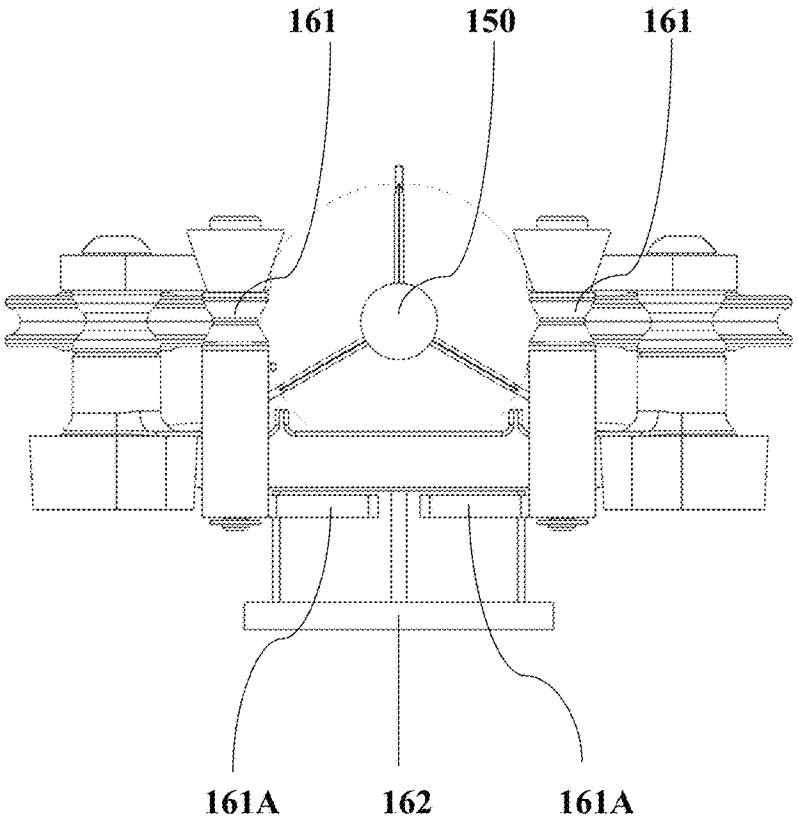
Figure 19A:
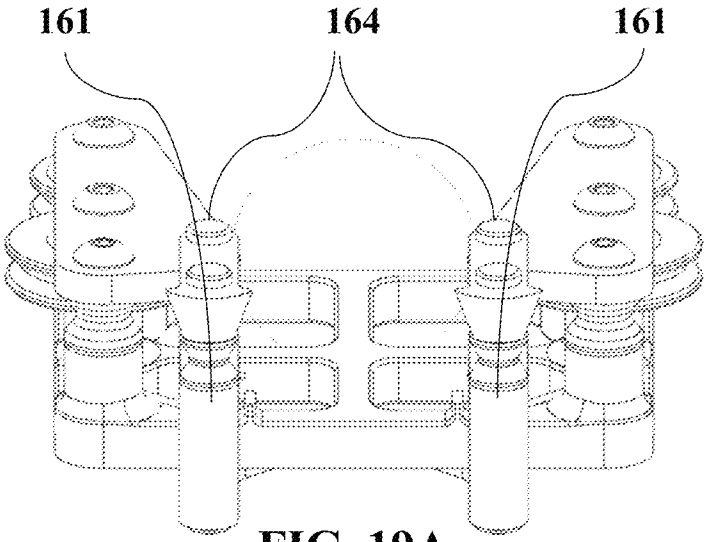
FIGS. 19A and 19C are perspective views showing the underside of the passive fall-away arrow rest with its brackets disengaging the fixed actuation structure of the system.
Figure 19B:
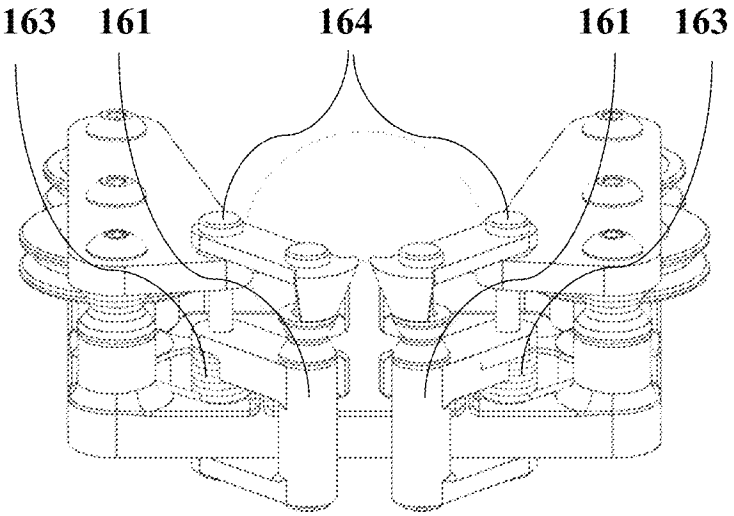
FIGS. 19B and 19D are perspective views showing the underside of the passive fall-away arrow rest with its brackets engaging the fixed actuation structure of the system.
Figure 19C:
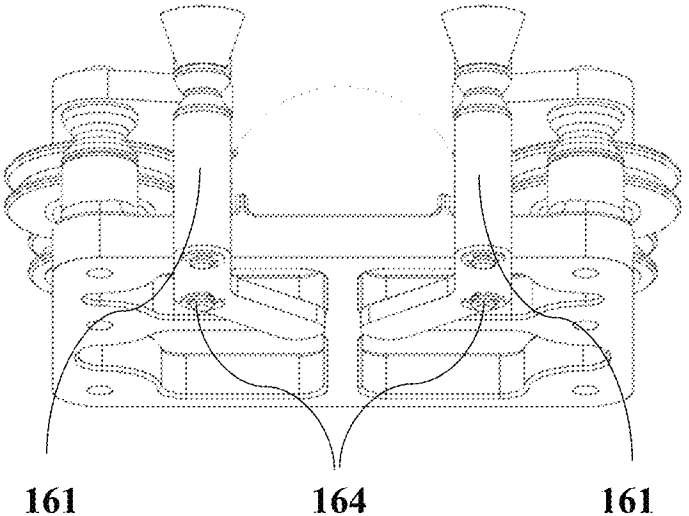
Figure 19D:
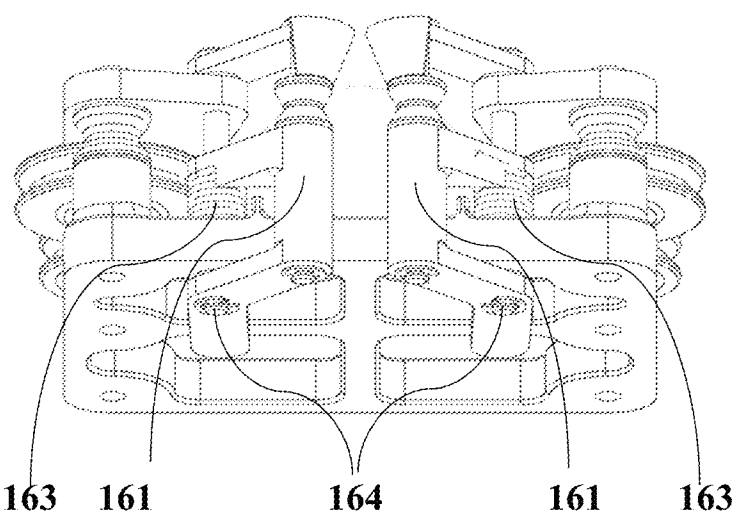

FIGS. 18A and 18B details the frontal movement of lateral shaft brackets 161 mounted to a movable pulley block. Lateral shaft brackets 161 move in one extreme to permit the arrow 150 and its fletching to pass through without making contact when loading or firing. In the other extreme, the lateral shaft brackets 161 capture the shaft of arrow 150 during the cocking process. Bracket levers 161A are located as a lower part of lateral shaft brackets 161. They move the lateral shaft brackets 161 in toward the shaft of the arrow 150 when they make contact with the angled-face of the fixed structure 162 during the cocking process. In the firing sequence the lateral shaft brackets 161 move away from the shaft of the arrow 150, driven by the torsion return springs 161.

FIGS. 19A through 19D highlight the system from two perspectives at the movement extremes of the lateral shaft brackets 161. Each lateral shaft bracket 161 is mounted to the pulley block via a single bracket axle 162, which also serves as a mount for each torsion return spring 161.

Figure 20A:
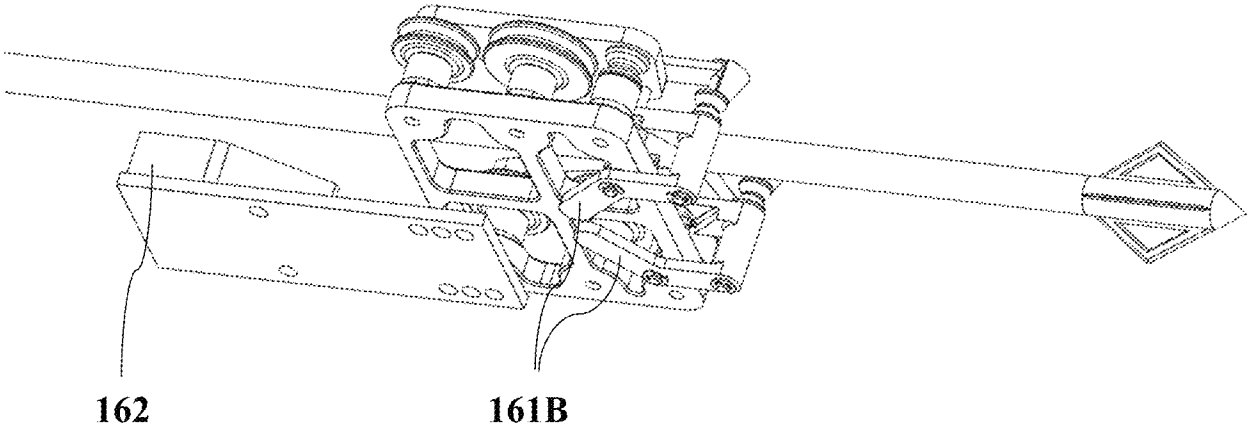
FIGS. 20A and 20B are frontal perspective views showing the passive fall-away arrow rest brackets range of motion.
Figure 20B:
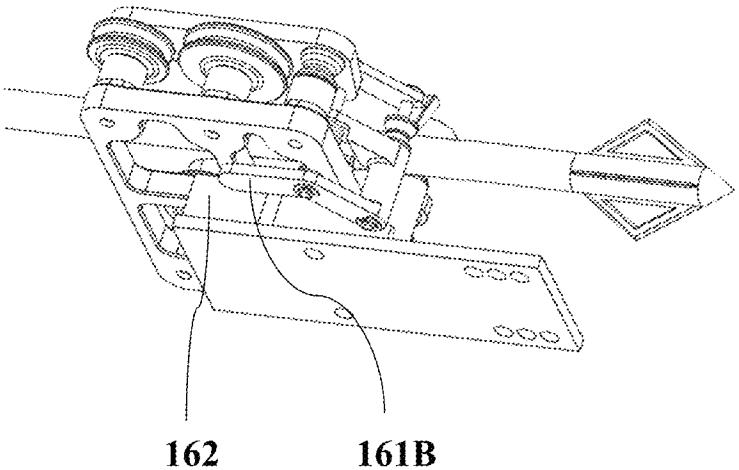

FIGS. 20A and 20B detail the movement of the lateral shaft bracket 161 as the bracket levers 161A make contact with fixed structure 162.

All the features disclosed in this specification, including any accompanying abstract and drawings, may be replaced by alternative features serving the same, equivalent or similar purpose, unless expressly stated otherwise. Thus, unless expressly stated otherwise, each feature disclosed is one example only of a generic series of equivalent or similar features.

Claim elements and steps herein may have been numbered and/or lettered solely as an aid in readability and understanding. Any such numbering and lettering in itself is not intended to and should not be taken to indicate the ordering of elements and/or steps in the claims.

Many alterations and modifications may be made by those having ordinary skill in the art without departing from the spirit and scope of the invention. Therefore, it must be understood that the illustrated embodiments have been set forth only for the purposes of examples and that they should not be taken as limiting the invention as defined by the following claims. For example, notwithstanding the fact that the elements of a claim are set forth below in a certain combination, it must be expressly understood that the invention includes other combinations of fewer, more or different ones of the disclosed elements.

The words used in this specification to describe the invention and its various embodiments are to be understood not only in the sense of their commonly defined meanings, but to include by special definition in this specification the generic structure, material or acts of which they represent a single species.

The definitions of the words or elements of the following claims are, therefore, defined in this specification to not only include the combination of elements which are literally set forth. In this sense it is therefore contemplated that an equivalent substitution of two or more elements may be made for any one of the elements in the claims below or that a single element may be substituted for two or more elements in a claim. Although elements may be described above as acting in certain combinations and even initially claimed as such, it is to be expressly understood that one or more elements from a claimed combination can in some cases be excised from the combination and that the claimed combination may be directed to a subcombination or variation of a subcombination.

Insubstantial changes from the claimed subject matter as viewed by a person with ordinary skill in the art, now known or later devised, are expressly contemplated as being equivalently within the scope of the claims. Therefore, obvious substitutions now or later known to one with ordinary skill in the art are defined to be within the scope of the defined elements.

The claims are thus to be understood to include what is specifically illustrated and described above, what is conceptually equivalent, what can be obviously substituted and also what incorporates the essential idea of the invention.

What is claimed is:

1. A torsion-driven counteracting block and tackle pulley type compact arrow launching device, comprising:

a speed-limited winch mounted within a rear stock of the torsion-driven counteracting block and tackle pulley type compact arrow launching device; and a nock release mounted on a top side of the torsion-driven counteracting block and tackle pulley type compact arrow launching device, wherein:

the nock release includes a release latch operable to removably engage a nock of an arrow;

the speed-limited winch is operable to move the nock release rearward within the torsion-driven counteracting block and tackle pulley type compact arrow launching device to move the arrow from a loaded position to a cocked position; and the speed-limited winch is operable to simultaneously tension a launching string of the torsion-driven counteracting block and tackle pulley type compact arrow launching device while drawing back the arrow during a cocking process.

2. The torsion-driven counteracting block and tackle pulley type compact arrow launching device of claim 1, wherein the speed-limited winch releases the arrow from the cocked position to a loaded position at a controlled speed.

3. The torsion-driven counteracting block and tackle pulley type compact arrow launching device of claim 2, wherein the speed-limited winch prevents an uncontrolled reversal of the nock release if a winding force is removed from the speed-limited winch during the cocking process.

4. The torsion-driven counteracting block and tackle pulley type compact arrow launching device of claim 1, further comprising a cord interconnecting the nock release with the speed-limited winch.

5. The torsion-driven counteracting block and tackle pulley type compact arrow launching device of claim 1, further comprising a passive fall-away arrow rest mounted within a pulley block along with an actuator mounted on a frame of the torsion-driven counteracting block and tackle pulley type compact arrow launching device, just below the pulley block.

6. The torsion-driven counteracting block and tackle pulley type compact arrow launching device of claim 1, further comprising a passive fall-away arrow rest mounted on a frame along with an actuator mounted on a pulley block of the torsion-driven counteracting block and tackle pulley type compact arrow launching device, just below the pulley block.

7. The torsion-driven counteracting block and tackle pulley type compact arrow launching device of claim 5, wherein the passive fall-away arrow rest engages an arrow shaft mid-way through the cocking process, without assistance from the user.

8. The torsion-driven counteracting block and tackle pulley type compact arrow launching device of claim 5, wherein the passive fall-away arrow rest, during a firing sequence, supports the arrow only through a mid-way point of a deployment of the arrow.

9. The torsion-driven counteracting block and tackle pulley type compact arrow launching device of claim 5, wherein the passive fall-away arrow rest includes a fixed structure mounted on top of the torsion-driven counteracting block and tackle pulley type compact arrow launching device, and lateral shaft brackets mounted on a movable pulley block of the torsion-driven counteracting block and tackle pulley type compact arrow launching device, wherein the lateral shaft brackets move to grip the arrow shaft as the movable pulley block and lateral shaft brackets make contact with the fixed structure.

10. The torsion-driven counteracting block and tackle pulley type compact arrow launching device of claim 1, further comprising a safety latch preventing release of the nock release from the nock of the arrow.

11. The torsion-driven counteracting block and tackle pulley type compact arrow launching device of claim 1, further comprising a trigger operable to move the nock release from the nock of the arrow to fire the arrow.

12. A cocking and release system within a compact arrow launching device, comprising:

a speed-limited winch mounted within a rear stock of the compact arrow launching device; and a nock release mounted on a top side of the compact arrow launching device, wherein:

the nock release includes a release latch operable to removably engage a nock of an arrow;

the speed-limited winch is operable to move the nock release rearward within the compact arrow launching device to move the arrow from a loaded position to a cocked position;

the speed-limited winch is operable to simultaneously tension a launching string of the torsion-driven counteracting block and tackle pulley type compact arrow launching device while drawing back the arrow during a cocking process; and the speed-limited winch prevents an uncontrolled reversal of the nock release if a winding force is removed from the speed-limited winch during the cocking process.

13. The cocking and release system of claim 12, wherein the speed-limited winch releases the arrow from the cocked position to a loaded position at a controlled speed.

14. The cocking and release system of claim 12, wherein the nock release draws the arrow into a cocked position during the cocking process without making contact directly with a launching string of the compact arrow launching device.

15. The cocking and release system of claim 12, further comprising a cord interconnecting the nock release with the speed-limited winch, wherein turning the speed-limited winch pulls the cord and begins the cocking process.

16. The cocking and release system of claim 12, further comprising a trigger operable to move the nock release from the nock of the arrow to fire the arrow.

17. An operating system of an arrow launching device, comprising:

a speed-limited winch mounted within a rear stock of the arrow launching device;

a nock release mounted on a top side of the arrow launching device; and a passive fall-away arrow rest mounted within a pulley block or on a frame along with an actuator mounted on the frame or within the pulley block of the arrow launching device, wherein:

the nock release includes a release latch operable to removably engage a nock of an arrow;

the speed-limited winch is operable to move the nock release rearward within the arrow launching device to move the arrow from a loaded position to a cocked position;

the speed-limited winch is operable to simultaneously tension a launching string of the operating system of the arrow launching device while drawing back the arrow during a cocking process;

the passive fall-away arrow rest engages an arrow shaft mid-way through the cocking process, without assistance from the user; and the passive fall-away arrow rest, during a firing sequence, supports the arrow only through a mid-way point of a deployment of the arrow.

18. The operating system of claim 17, wherein the speed-limited winch prevents an uncontrolled reversal of the nock release if a winding force is removed from the speed-limited winch during the cocking process.

19. The operating system of claim 17, wherein the speed-limited winch releases the arrow from the cocked position to a loaded position at a controlled speed.

20. The operating system of claim 17, wherein the nock release draws the arrow into a cocked position during the cocking process without making direct contact with a launching string of the arrow launching device.

* * * * *